US008148617B2

(12) United States Patent
Hashimoto et al.

(10) Patent No.: US 8,148,617 B2
(45) Date of Patent: Apr. 3, 2012

(54) DRUM PAD AND MANUFACTURING METHOD THEREOF

(75) Inventors: Ryuji Hashimoto, Hamamatsu (JP); Shuichi Sawada, Hamamatsu (JP); Kenichi Nishida, Hamamatsu (JP); Keizo Harada, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 144 days.

(21) Appl. No.: 12/776,299

(22) Filed: May 7, 2010

(65) Prior Publication Data

US 2010/0282048 A1 Nov. 11, 2010

(30) Foreign Application Priority Data

May 8, 2009 (JP) ..... 2009-113499
May 8, 2009 (JP) ..... 2009-113501
Jul. 24, 2009 (JP) ..... 2009-172901

(51) Int. Cl.
*G10D 13/02* (2006.01)

(52) U.S. Cl. ..... 84/411 P

(58) Field of Classification Search ..... 84/411 P, 84/411 R, 414
See application file for complete search history.

(56) References Cited

U.S. PATENT DOCUMENTS 1,923,512 A * 8/1933 Stein ..... 428/175
2,782,139 A * 2/1957 Hill et al. ..... 428/195.1
4,308,782 A * 1/1982 Hartry ..... 84/414
5,520,090 A * 5/1996 Eagle ..... 84/411 P
5,932,823 A * 8/1999 Jacobs ..... 84/411 P
5,986,196 A * 11/1999 Behrenfeld ..... 84/411 M
5,998,716 A * 12/1999 Marquez et al. ..... 84/411 P
6,121,538 A * 9/2000 Yoshino et al. ..... 84/738
6,271,458 B1 * 8/2001 Yoshino et al. ..... 84/738
6,601,436 B1 * 8/2003 Senda et al. ..... 73/12.09
6,982,376 B2 * 1/2006 Wise ..... 84/600
7,135,630 B2 * 11/2006 Maruhashi et al. ..... 84/411 P
7,385,135 B2 * 6/2008 Yoshino et al. ..... 84/738
7,439,432 B2 * 10/2008 Hiraku ..... 84/414
7,816,597 B2 * 10/2010 Okada et al. ..... 84/414
7,926,351 B2 * 4/2011 Masaki et al. ..... 73/718
2005/0211062 A1 * 9/2005 Hiraku ..... 84/414
2010/0282048 A1 * 11/2010 Hashimoto et al. ..... 84/743

FOREIGN PATENT DOCUMENTS

JP 2005-227535 8/2005

* cited by examiner

*Primary Examiner* — Elvin G Enad
*Assistant Examiner* — Robert W Horn
(74) *Attorney, Agent, or Firm* — Morrison & Foerster LLP

(57) ABSTRACT

A drum pad capable of providing an excellent percussion feeling and securely adhering a base portion to a body portion made of rubber. The drum pad has a rear-side clothlike material which is provided on a rear surface of the body portion and into which the rubber of the body portion is impregnated. The base portion is fixed to a rear surface of the rear-side clothlike material via a fixing layer made of pressure sensitive adhesive or adhesive and provided on the rear surface of the rear-side clothlike material.

37 Claims, 7 Drawing Sheets

DRUM PAD AND MANUFACTURING METHOD THEREOF

BACKGROUND OF THE INVENTION

1. Field of the Invention

The present invention relates to a drum pad for use as an electronic drum pad or a practice pad, and a manufacturing method of the same.

2. Description of the Related Art

Conventionally, a drum pad for use in an electronic drum or the like has been known, which generally has an elastic pad portion having a percussion surface, and a base portion provided on a rear side of the pad portion and mounted with a sensor for detecting the striking of the pad portion.

For example, Japanese Laid-open Patent Publication No. 2005-227535 discloses an electronic drum pad, in which an iron plate as a base portion is fixed to a rear side of a pad portion, a sensor board made of resin is fixed to a rear surface of the iron plate, and a sensor is fixed to a rear surface of the sensor board.

The sensor comprised of a piezoelectric device detects a variation conveyed from the pad portion being struck to the iron plate and the sensor board, and outputs a detection signal. Accordingly, the striking of the pad portion is detected by detecting a vibration of the iron plate and the sensor board.

However, a vibration of the base portion formed of the iron plate does not attenuate immediately. Accordingly, when a trigger for sounding a drum sound is detected from the detection signal representing a striking vibration, there is a fear that the trigger is erroneously detected twice or more while the striking vibration continues and that the next trigger cannot be detected if the pad portion is struck again before the preceding striking vibration does not attenuate. Thus, a problem. is posed that the striking cannot be detected accurately, resulting in erroneous sounding.

Aside from electronic sounding, a "bong" mechanical percussion sound is sometimes produced when the pad portion is struck. The mechanical percussion sound, if excessively large, causes a problem that musical performance is hindered.

Heretofore, it has been demanded for the drum pad for electronic drum or the like to provide a percussion feeling as close as possible to that of an acoustic drum pad. To meet the demand, improvement in raw material of the body portion of the drum pad has been investigated.

To provide a satisfactory percussion feeling and to perform a proper percussion detection, the base portion mounted with a percussion detection sensor must be securely fixed to the body portion of the drum pad. Usually, the base portion is fixed to the body portion by using an adhesive.

However, among raw materials of the body portion that provide a satisfactory percussion feeling, there are some that do not allow an adhesive to stick well, and therefore, actually usable materials are limited. For example, ordinary adhesive does not properly stick to, e.g., a silicone-based rubber material. Accordingly, it is difficult to adhere the base portion having, e.g., a metallic contact surface to the body portion made of silicone rubber material using adhesive, and therefore, a double-sided adhesive tape or an adhesive for silicone must be used, which results in increased cost. In addition, it is difficult to ensure the required adhesion strength. The above is a bottleneck in using a silicone-based rubber material as a material of the body portion of the drum pad.

In studying a material for the body portion of the drum pad, it is also necessary to consider how to securely join a front surface material constituting the percussion surface, etc. to the body portion by using, e.g., adhesive .

SUMMARY OF THE INVENTION

The present invention provides a drum pad capable of providing an excellent percussion feeling and securely adhering a base portion to a body portion made of rubber, and provides a manufacturing method of the drum pad.

The present invention also provides a drum pad capable of suppressing a mechanical percussion sound and capable of enhancing the effect of damping a high-frequency vibration caused by the striking, thereby preventing erroneous sounding when a sound is sounded based on percussion detection.

According to a first aspect of this invention, there is provided a drum pad which includes a body portion made of rubber and having a rear surface thereof on a side opposite from a side where the drum pad is struck; a rear-side clothlike material provided on the rear surface of the body portion; and a fixing layer made of adhesive and provided on a rear surface of the rear-side clothlike material, wherein the body portion is joined to a front surface of the rear-side clothlike material by impregnating the rear-side clothlike material with the rubber of the body portion.

With the above drum pad, it is possible to realize an excellent percussion feeling and to securely adhere a base portion to the rear surface of the body portion made of rubber.

The drum pad can include a base portion fixed to the rear surface of the rear-side clothlike material via the fixing layer.

With this construction, the drum pad whose base portion is securely adhered to the rear surface of the body portion made of rubber can be obtained.

The drum pad can include a front-side clothlike material having a rear surface thereof to which the body portion is joined and a front surface thereof opposite from the rear surface of the front-side clothlike material, wherein the front-side clothlike material includes a first layer portion on a side of the front surface of the front-side clothlike material, the first layer portion formed by intruding a stretchable resin material into the front-side clothlike material, and a second layer portion between the first layer portion and the body portion, the second layer portion being impregnated with the rubber of the body portion. Both the rear-side clothlike material and the front-side clothlike material can be one of a knitted material and unwoven cloth.

With the above construction, it is possible to prevent a percussion surface from being contaminated and to maintain the durability.

The rubber can be foamed rubber.

In this case, it is possible to effectively obtain a softly bouncy percussion surface.

The rubber can be silicone rubber having a siloxane bond.

In the case, liquid rubber can be used as the rubber material, making it easy to cast the rubber and making it possible to effectively manufacture the drum pad which is excellent in rebounding property and weathering resistance.

According to a second aspect of this invention, there is provided a drum pad, which includes a pad portion having a surface thereof adapted to be struck, and a base portion disposed on a rear side of the pad portion, wherein the base portion includes first and second metal plates and a resin layer interposed between the first and second metal plates.

With the above drum pad, it is possible to suppress a mechanical percussion sound and to enhance the effect of damping a high-frequency vibration generated by the striking, thereby making it possible to prevent erroneous sounding in a case where a sound is sounded based on percussion detection.

The drum pad can include a percussion sensor configured to detect a vibration of the base portion to thereby detect striking of the surface of the pad portion.

With the above construction, it is possible to prevent the percussion sensor from performing erroneous detection, thus making it possible to prevent a sound from being erroneously sounded.

The first and second metal plates can each have a thickness in a range of 0.3 mm to 2.3 mm, and the resin layer can have a thickness equal to or larger than 0.1 mm.

With this construction, it is possible to properly ensure the high-frequency vibration damping effect.

The resin layer can be thinner than the first metal plate or the second metal plate, whichever is thinner.

With this construction, it is possible to reduce waste of resin, to thereby suppress the cost.

The first and second metal plates can have a same construction.

In this case, it is possible to reduce the number of component parts to thereby simplify the construction.

According to a third aspect of this invention, there is provided a drum pad including a body portion made of rubber and having a rear surface thereof on a side opposite from a side where the drum pad is struck; a rear-side clothlike material provided on the rear surface of the body portion; and a base portion having at least a member formed with holes extending therethrough in a front-rear direction, the base portion being fixed at a side of the member to a rear surface of the rear-side clothlike material via a fixing layer made of adhesive, wherein the body portion is joined to a front surface of the rear-side clothlike material by impregnating the rear-side clothlike material with the rubber of the body portion.

With the above drum pad, an excellent percussion feeling can be provided, and the base portion can securely be adhered to the rear surface of the body portion made of rubber.

The holes can be distributed in a higher density in a region further away from an outer periphery of the base portion.

With this construction, venting is much promoted in a region closer to the center of the base portion, thereby making the adhesion strength uniform over the entire surface of the base portion.

The drum pad can include a front-side clothlike material having a rear surface thereof to which the body portion is joined and a front surface thereof opposite from the rear surface of the front-side clothlike material, wherein the front-side clothlike material comprises a first layer portion on a side of the front surface of the front-side clothlike material, the first layer portion formed by intruding a stretchable resin into the front-side clothlike material, and a second layer portion between the first layer portion and the body portion, the second layer portion being impregnated with the rubber of the body portion.

With the above construction, it is possible to prevent a percussion surface from being contaminated and to maintain the durability.

According to a fourth aspect of this invention, there is provided a manufacturing method of a drum pad including a body portion having a rear surface thereof on a side opposite from a side where the drum pad is struck, and a rear-side clothlike material provided on the rear surface of the body portion. The method includes a disposing step of disposing the rear-side clothlike material in the mold, a rear surface of the rear-side clothlike material provided with a fixed layer made of adhesive and a molding step of casting liquid resin material or thermally-softened non-vulcanized rubber into a mold, to thereby form the body portion made of rubber and join the body portion to the front surface of the rear-side clothlike material by impregnating the rear-side clothlike material with the liquid resin material or thermally-softened non-vulcanized rubber.

With the above manufacturing method, it is possible to provide a drum pad able to realize an excellent percussion feeling and to securely adhere the base portion to the rear surface of the body portion made of rubber.

According to a fifth aspect of this invention, there is provided a manufacturing method of a drum pad including a front-side clothlike material that has a front surface thereof on a side where the drum pad is struck and a rear surface thereof opposite from the front surface, a body portion having a front surface thereof affixed to the rear surface of the front-side clothlike material and a rear surface thereof opposite from the front surface thereof, and a rear-side clothlike material provided on the rear surface of the body portion. The method includes a thermal adhesion step of forming a first layer portion in the front-side clothlike material on a side of the front surface thereof by intruding the front surface of the front-side clothlike material with a molten stretchable resin material which is solidified integrally with the front-side clothlike material; a disposing step of disposing the front-side clothlike material with the first layer portion in a mold; a disposing step of disposing the rear-side clothlike material in the mold, a front surface of the rear-side clothlike material opposite to the rear surface of the front-side clothlike material, a rear surface of the rear-side clothlike material provided with a fixing layer of adhesive; and a molding step of casting liquid resin material or thermally-softened non-vulcanized rubber into a mold from between the rear surface of the front-side clothlike material and a front surface of the rear-side clothlike material to thereby form the body portion made of rubber, wherein a second layer portion in the front-side clothlike material is formed by impregnating the front-side clothlike material with the liquid resin material or thermally-softened non-vulcanized rubber between the first layer portion of the front-side clothlike material and the body portion, thereby joining the body portion to the rear surface of the front-side clothlike material, and wherein the rear-side clothlike material is impregnated with the liquid resin material or thermally-softened non-vulcanized rubber, thereby joining the body portion to the front surface of the rear-side clothlike material.

With the above manufacturing method, it is possible to provide a drum pad able to securely adhere a base portion to the rear surface of the body portion made of rubber, to prevent a percussion surface from being contaminated, and to maintain the durability. In addition, since processing on the front side and processing on the rear side can be performed concurrently in one molding process, it is possible to simplify the process of fabrication.

According to a sixth aspect of this invention, there is provided a manufacturing method of a drum pad including a body portion having a rear surface thereof on a side opposite from a side where the drum pad is struck, and a rear-side clothlike material provided on the rear surface of the body portion. The method includes a disposing step of disposing in a mold a rear-side clothlike material with a rear surface affixed to a base portion via a fixing layer made of adhesive, the base portion comprising at least a member formed with holes extending therethrough in a front-rear direction; and a molding step of casting liquid resin material or thermally-softened non-vulcanized rubber into a mold from the side close to the front surface of the rear-side clothlike material, to thereby form the body portion made of rubber and join the body portion to the front surface of the rear-side clothlike material by impregnating the rear-side clothlike material with the liquid resin material or thermally-softened non-vulcanized rubber.

With the above manufacturing method, it is possible to provide a drum pad able to realize an excellent percussion feeling and to securely adhere the base portion to the rear surface of the pad portion made of rubber.

According to a seventh aspect of this invention, there is provided a manufacturing method of a drum pad including a front-side clothlike material that has a front surface thereof on a side where the drum pad is struck and a rear surface thereof opposite from the front surface, a body portion having a front surface thereof affixed to the rear surface of the front-side clothlike material and a rear surface thereof opposite from the front surface thereof, and a rear-side clothlike material provided on the rear surface of the body portion. The method includes a thermal adhesion step of forming a first layer portion in the front-side clothlike material on a side of the front surface thereof by intruding the front surface of the front-side clothlike material with a molten stretchable resin material which is solidified integrally with the front-side clothlike material; a disposing step of disposing the front-side clothlike material with the first layer portion in a mold; a disposing step of disposing in a mold the rear-side clothlike material in a mold, a front surface of the rear-side clothlike material opposite to the rear surface of the front-side clothlike material, the rear-side cloth material with a rear surface affixed to a base portion via a fixing layer made of adhesive, the base portion comprising at least a member formed with holes extending therethrough in a front-rear direction; and a molding step of casting liquid resin material or thermally-softened non-vulcanized rubber into a mold from between the rear surface of the front-side clothlike material and a front surface of the rear-side clothlike material, to thereby form the body portion made of rubber, wherein a second layer portion in the front-side clothlike material is formed by impregnating the front-side clothlike material with the liquid resin material or thermally-softened non-vulcanized rubber between the first layer portion of the front-side clothlike material and the body portion, thereby joining the body portion to the rear surface of the front-side clothlike material, and wherein the rear-side clothlike material is impregnated with the liquid resin material or thermally-softened non-vulcanized rubber, thereby joining the body portion to the front surface of the rear-side clothlike material.

With the above manufacturing method, it is possible to provide a drum pad able to realize an excellent percussion feeling, to securely adhere the base portion to the rear surface of the body portion made of rubber, to prevent a percussion surface from being contaminated, and to maintain the durability. In addition, since processing on the front side and processing on the rear side can be carried out concurrently in one molding process, it is possible to simplify the process of fabrication.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1A:
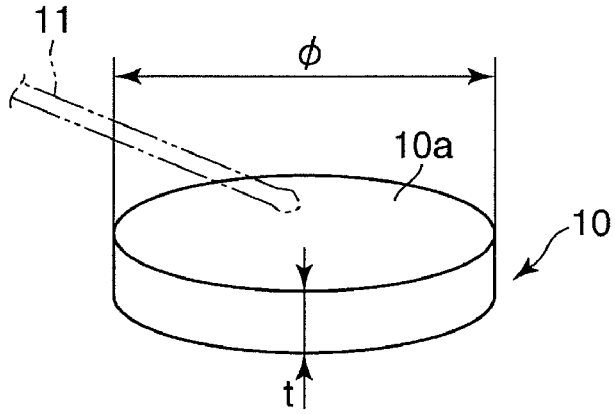
FIG. 1A is a perspective view schematically showing a drum pad according to one embodiment of this invention.

FIG. 1A schematically shows in perspective view a drum pad according to one embodiment of this invention. The drum pad shown at 10 in FIG. 1A is for use as, e.g., an electronic drum pad or a percussion input device for receiving percussion data to obtain sounding data, the drum pad 10 being adapted to be struck by a stick 11 or the like. The drum pad 10 is not, however, limited to these examples, and may be a pad for use as percussion practice, which is singly laid on a table or the like when used. The drum pad 10 is formed into, e.g., a disk-shape having a diameter $\phi$ of 260 mm and a thickness t of 20 mm for use in a 10 or 12 inch snare drum or tom although the shape, size, and intended use of the drum pad 10 are not limited thereto.

Figure 1B:
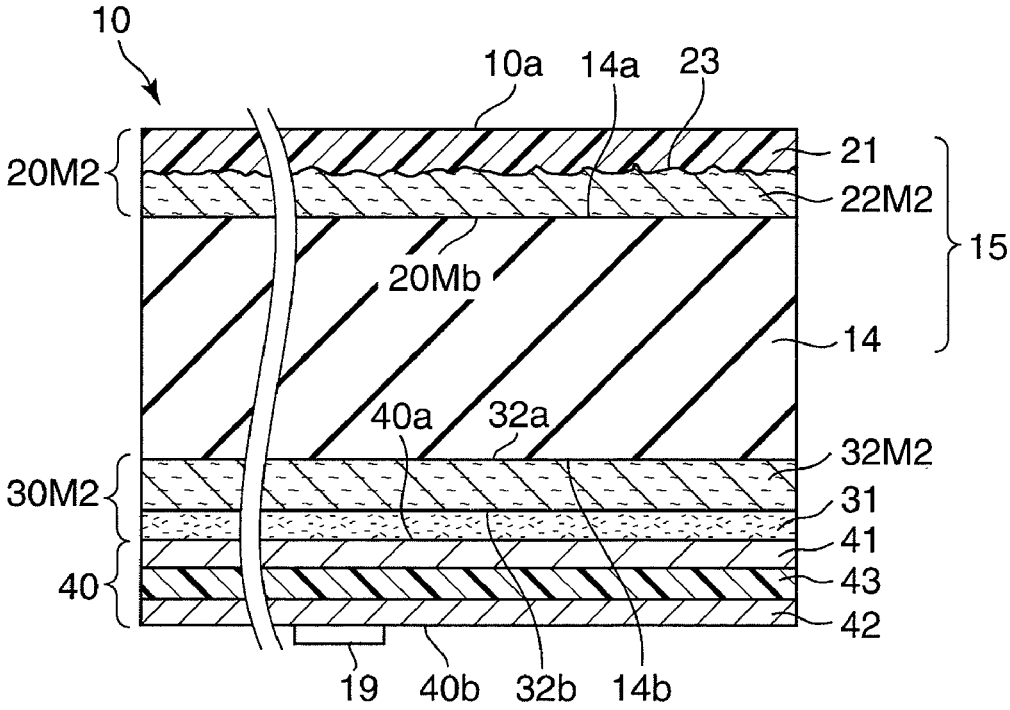
FIG. 1B is a section view of the drum pad.

FIG. 1B schematically shows the construction of the drum pad 10 in cross section. For convenience of explanation, it is assumed that the drum pad 10 is disposed to be horizontal as shown in FIG. 1B although the orientation of the drum pad 10 at the time of performance is not limited. In the following, the upper and lower sides in the drawings will be referred to as the front and rear sides, respectively. Some parts of the drum pad 10 are illustrated with exaggerated thicknesses and with a scale different from actual one.

As shown in FIG. 1B, the drum. pad 10 is comprised of a pad portion 15, a rear-side composite layer 30M2, and a base portion 40, which are stacked in this order from above. The pad portion 15 is comprised of a body portion 14 and a front-side composite layer 20M2 formed on an upper surface 14*a* of the body portion 14. The composite layer 20M2 is comprised of first and second layer portions 21, 22M2, which are vertically separated at a boundary portion 23. In the front-side composite layer 20M2, the entire region other than the first layer portion 21 is occupied by the second layer portion 22M2.

The front-side composite layer 20M2 has a front surface 20Ma (which is an upper surface, i.e., a percussion surface 10*a*, of the drum pad 10) and a rear surface 20Mb joined to an upper surface 14*a* of the body portion 14. The surfaces 20Ma, 20Mb are each formed to be flat, and the boundary portion 23 can be formed to be flat or non-flat.

The rear-side composite layer 30M2 is comprised of a rear-side clothlike material 32M2 and a pressure sensitive adhesive 31 applied to a rear surface 32*b* of the clothlike material 32M2 whose front surface 32*a* is joined to a lower surface 14*b* of the body portion 14.

The base portion 40, which is provided on the lower side of the rear-side composite layer 30M2, has a three-layer structure comprised of a front-side first metal plate 41, a rear-side second metal plate 42, and a resin layer 43 interposed between the metal plates 41, 42. The base portion 40 is adhered at its upper surface 40*a* (which is an upper surface of the first metal plate 41) to a rear surface 32*b* of the clothlike material 32M2 by the pressure sensitive adhesive 31.

A percussion sensor 19 is fixed to near the center of a lower surface 40*b* of the base portion 40 (which is a lower surface of the second metal plate 42). The percussion sensor 19 has a piezoelectric device for converting a vibration of the base portion 40 into an electrical signal representing whether the drum pad 10 is struck and the intensity of striking. It should be noted that the percussion sensor 19 can have any construction and can be disposed at any position so long as it can detect the striking in terms of vibration. When the percussion surface 10*a* of the drum pad 10 is struck, the base portion 40 vibrates and the vibration is detected by the percussion sensor 19. A trigger can be detected from a detection signal output from the sensor 19, and a drum sound can be generated by a musical tone generator (not shown).

Figure 2A:
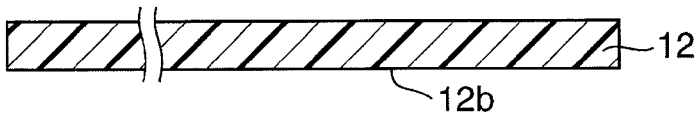
FIG. 2A is a section view of a resin material used for production of the drum pad.
Figure 2B:
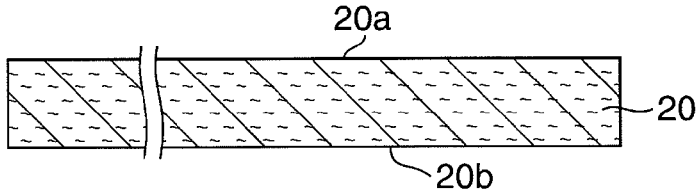
FIG. 2B is a section view of a front-side clothlike material used for production of the drum pad.
Figure 2C:
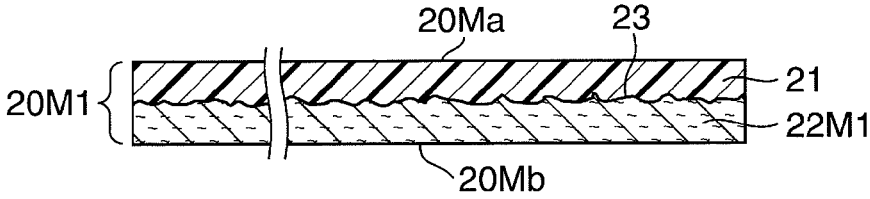
FIG. 2C is a section view of a temporary composite layer corresponding to a front-side composite layer of the drum pad.

FIGS. 2A and 2B show in cross section respective ones of a resin material 12 and a front-side clothlike material 20, which are used for production of the drum pad 10. FIG. 2C shows in cross section a temporary composite layer corresponding to the front-side composite layer 20M2 of the drum pad 10.

Figure 3A:
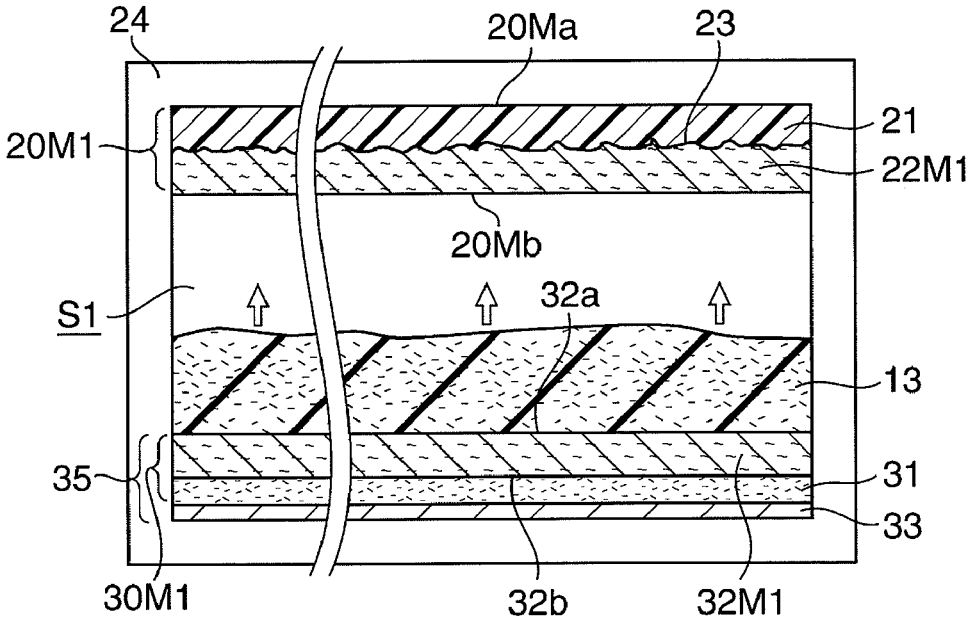
FIG. 3A is a section view showing a molding process of the drum pad except for the base portion.

In a raw material stage, the pad portion 15 is comprised of a resin material 12, a front-side clothlike material 20, and a rubber material 13 (see FIG. 3A). The rubber material 13 is a molding material for the body portion 14. The resin material 12 and the clothlike material 20 are much thinner than the body portion 14, and the resin material 12 is thinner than the clothlike material 20.

As the front-side clothlike material 20 (see FIG. 2B), a material stretchable in any two-dimensional direction (2-way stretchable), e.g., a knitted material, is used, but unwoven cloth may be used. By using either of these materials, a direction in which the stick 11 is rebounded becomes similar to that in an acoustic drum pad.

The knitted material here represents a knitted cloth or other cloth in which looped yarns are laterally or vertically coupled together. The unwoven cloth represents a cloth in which fibers are coupled together without being woven or knitted. For the unwoven cloth, the kind of fibers is not limited, and natural fibers or synthetic fibers may be used.

As the resin material 12 (see FIG. 2A), a stretchable film-like resin material capable of being thermally fused and bonded to the front-side clothlike material 20 is used. For example, polyolefin is used. Alternatively, polyurethane resin, mixture of polyurethane and polyester, or mixture of polyurethane and nylon may be employed.

As the rubber material 13 (see FIG. 3A), silicone rubber having a siloxane bond (e.g., foamy silicone RTV rubber) is suitable.

As described later, when the rubber material 13 is formed into the body portion 14, a temporary second layer portion 22M1 of a temporary composite layer 20M1 shown in FIG. 2C is impregnated with the rubber material 13 to become the second layer portion 22M2 shown in FIG. 1B.

Figure 2D:
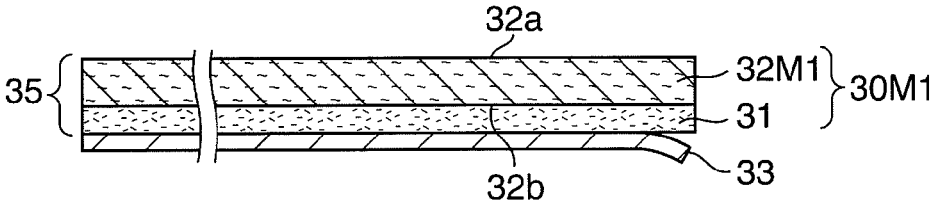
FIG. 2D is a section view of a separate paper-equipped composite layer used for production of the drum pad.

FIG. 2D shows in cross section a separate paper-equipped composite layer, which is used for production of the drum pad 10. The separate paper-equipped composite layer 35 is comprised of a temporary composite layer 30M1 and a separate paper 33. The layer 30M1 is comprised of a temporary rear-side clothlike material 32M1 and the pressure sensitive adhesive 31 applied to a lower surface of the clothlike material 32M1. The separate paper 33 is affixed to a rear surface of the adhesive 31. As described later, when the rubber material 13 is formed into the body portion 14, the clothlike material 32M1 shown in FIG. 2D is impregnated with the rubber material 13 to become the rear-side clothlike material 32M2 shown in FIG. 1B.

As with the front-side clothlike material 20 (see FIG. 2B), a knitted material is used as a raw material of the temporary rear-side clothlike material 32M1. Alternatively, unwoven cloth, or a combination of knitted material for the front-side clothlike material 20 and unwoven cloth for the temporary rear-side clothlike material 32M1, or the reverse combination may be used. It should be noted that felt or other cloth than knitted material or unwoven cloth may be used for the clothlike material 32M1 which is not required to have stretchability.

As the pressure sensitive adhesive 31, e.g., acrylic adhesive is suitable, but adhesive having a good adhesion to the first metal plate 41 may be used, such as rubber-based adhesive, silicone-based adhesive, or hot melt, which is selected according to a material of the first metal plate 41.

Figure 2E:
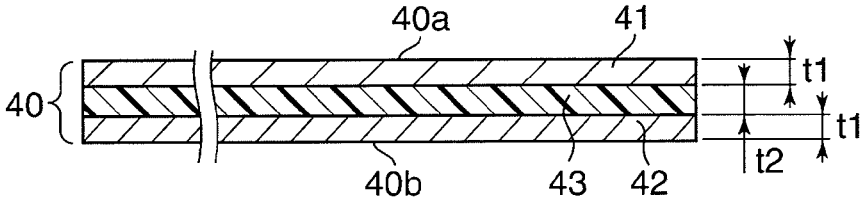
FIG. 2E is a section view of a base portion of the drum pad.

FIG. 2E shows the base portion 40 in cross section. As previously described, the base portion 40 is comprised of the first and second metal plates 41, 42 and the resin layer 43 interposed therebetween. The metal plates 41, 42 which are the same in construction each have a thickness of tl and are each made of an ordinary steel plate of aluminum, stainless, or iron. The resin layer 43 has a thickness of t2 and is made of, e.g., vinyl chloride resin or acrylate resin although not limitative thereto. To fix the metal plates 41, 42 and the resin layer 43 together, the resin layer 43 formed into, e.g., a sheet is affixed to the metal plates 41, 42 using a pressure sensitive adhesive double coated tape or the like.

The base portion 40 is configured as a laminated damping steel sheet that has an excellent vibration damping effect, especially, an excellent high-frequency vibration damping effect, which is attained by the three-layer structure having the resin layer 43 interposed between the metal plates 41, 42. To enable the base portion 40 to exhibit the required vibration damping effect and to suppress the cost, the thickness tl of the metal plates 41, 42 is set in a range of 0.3 mm to 2.3 mm (e.g., at 0.8 mm) and the thickness t2 of the resin layer 43 is set in a range of 0.1 mm to 0.5 mm (e.g., at 0.5 mm).

The reason why the thickness tl of the metal plates 41, 42 is selected to be in the above range is to enable the base portion 40 properly vibrates when the percussion surface 10*a* is struck. The reason why the thickness t2 of the resin layer 43 is selected to be in the above range is as follows: If the thickness t2 is made less than 0.1 mm, the vibration damping effect becomes small, and if excessively thinned, the resin layer 43 is hard to be fabricated. On the other hand, even if the thickness t2 is made thicker than 0.5 mm, the vibration damping effect is not further improved. If the resin layer 43 is excessively thickened, resin material is wasted. Since the vibration damping effect is exhibited even if the resin layer 43 has a thickness thicker than 0.5 mm, it is not inevitably necessary to limit the thickness t2 to a value not greater than 0.5 mm.

To reduce the waste of resin in order to suppress the cost, the thickness t2 of the resin layer 43 is preferably made thinner than the thickness tl of the metal plates 41, 42. It should be noted that it is not inevitably necessary to configure the metal plates 41, 42 to have the same thickness so long as their thicknesses are in the above range. In that case, preferably, the resin layer 43 is made thinner than the first metal plate 41 or the second metal plate 42, whichever is thinner.

Next, a manufacturing method of the drum pad 10 will be described with reference to FIGS. 2A to 2D and FIG. 3A.

FIG. 3A illustrates in cross section a molding process of the drum pad 10 except for the base portion 40.

First, the resin material 12, the front-side clothlike material 20, and the separate paper-equipped composite layer 35 are prepared (see FIGS. 2A, 2B, and 2D), each of which is formed to have a predetermined shape (e.g., circular shape) and a predetermined thickness. The resin material 12 has a thickness of about 0.1 mm, and the front-side clothlike material 20 has a thickness of about 0.2 mm. It should be noted that the resin material 12, the clothlike material 20, and the composite layer 35 may be cut later in a circular shape along with the body portion 14 after the body portion 14 is molded.

Then, the resin material 12 (see FIG. 2A) is thermally fused and bonded at the rear surface 12*b* to the front surface 20*a* of the front-side clothlike material 20. This is accomplished by, e.g., causing the resin material 12 and the clothlike material 20, which are laid overlap each other, to pass through two heated rollers.

It is assumed here that the melting point of the resin material 12 is lower than that of the front-side clothlike material 20, and the resin material 12 is thinner than the clothlike material 20. Accordingly, when the resin material 12 and the clothlike material 20 which are overlappingly laid are fused and bonded at a temperature at which the resin material 12 melts, the molten resin material 12 intrudes, as shown in FIG. 2C, into a region on the front side of the front-side clothlike material 20. The region extends from the front surface 20*a* of the clothlike material 20 to the boundary portion 23 and corresponds to the thickness of the resin material 12. When the front-side clothlike material 20 is cooled in this state, a first layer portion 21 is formed in the front-side region of the clothlike material 20 into which the resin material 12 has intruded. In the first layer portion 21, the resin material 12 has solidified and has been made integral with an upper half of the clothlike material 20. On the other hand, the remaining region of the clothlike material 20 (extending from the boundary portion 23 to the rear surface 20*b*) other than the first layer portion 21 becomes the temporary second layer portion 22M1 formed of only the knitted material.

In the resultant temporary composite layer 20M1, the front surface 20*a* of the front-side clothlike material 20 forms a front surface 20Ma of the first layer portion 21, and the rear surface 20*b* of the clothlike material 20 forms a rear surface 20Mb of the temporary composite layer 20M1.

Next, as shown in FIG. 3A, the separate paper-equipped composite layer 35 is disposed at the bottom of a mold 24 such that the temporary rear-side clothlike material 32M1 is positioned upward of the pressure sensitive adhesive 31 and the separate paper 33, and the temporary composite layer 20M1 is disposed on the ceiling side in the mold 24 such that the temporary second layer portion 22M1 is positioned downward of the first layer portion 21. Then, the rubber material 13 is cast between the separate paper-equipped composite layer 35 and the temporary composite layer 20M1, thereby molding the body portion 14.

Specifically, liquid material A and liquid material B as two-liquid type RTV rubber are weighed and mixed well. Then, the mixture of materials A and B is cast into the mold 24, and the mixture is foamed and solidified at a room temperature after the mold 24 is closed. A space S1 initially present in the mold 24 on the side close to the rear surface 20Mb of the temporary composite layer 20M1 is gradually filled with the foamed rubber material 13.

During the rubber material 13 is foamed, the rubber material 13 is impregnated into the temporary rear-side clothlike material 32M1 of the temporary composite layer 30M1 from above. The impregnation stops at a boundary between the clothlike material 32M1 and the pressure sensitive adhesive 31. When reaching the temporary composite layer 20M1, the rubber material 13 is impregnated into the temporary composite layer 20M1 from the rear surface 20Mb thereof. Since the first layer portion 21 of the temporary composite layer 20M1 is already impregnated with the resin material 12, the rubber material 13 is not impregnated into the first layer portion 21 and the impregnation stops at the boundary portion 23. In other words, the first layer portion 21 serves as a stopper for preventing the rubber material 13 from impregnating into a region of the temporary composite layer 20M1 on the front surface 20Ma side. Subsequently, annealing is performed.

As a result, the foamed and solidified rubber material 13 forms the body portion 14 (see FIG. 1B). On the side upward of the body portion 14, the temporary second layer portion 22M1 becomes the second layer portion 22M2 impregnated with the rubber material 13. As shown in FIG. 1B, the first and second layer portions 21 and 22M2 form the front-side composite layer 20M2, which is bonded at its rear surface 20Mb to the upper surface 14*a* of the body portion 14, whereby the pad portion 15 is formed.

On the side downward of the body portion 14, the temporary rear-side clothlike material 32M1 becomes the rear-side clothlike material 32M2 impregnated with the rubber material 13 (see FIG. 1B). The clothlike material 32M2 and the pressure sensitive adhesive 31 form the rear-side composite layer 30M2. The rear-side clothlike material 32M2 is bonded at its front surface 32*a* to the lower surface 14*b* of the body portion 14.

The second layer portion 22M2 and the rear-side clothlike material 32M2 each impregnated with the rubber material 13 are each joined to the body portion 14. In each joining area, fibers of the knitted cloth or the unwoven cloth forming the layer portion 22M2 (or the clothlike material 32M2) extend across the body portion 14 and the layer portion 22M2 (or the clothlike material 32M2). Therefore, the bonding strength is high. In addition, since an adhesive agent for the bonding is unnecessary, the manufacturing process is simplified. It should be noted that the configuration and orientation of the mold 24 are not limited to those of the illustrated example.

Figure 3B:
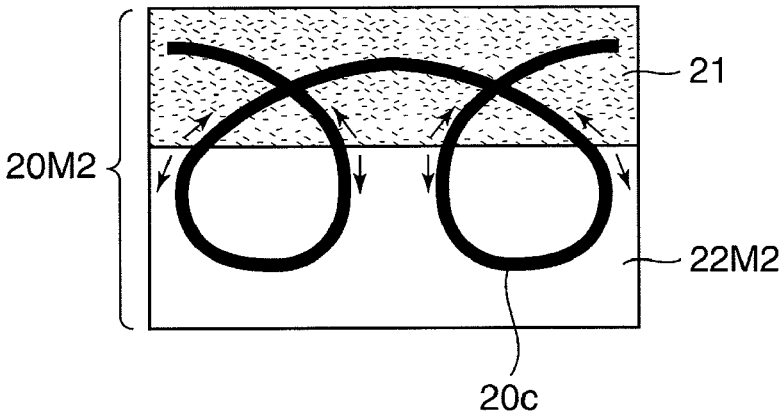
FIG. 3B is a schematic view of a front-side composite layer of the drum pad.

FIG. 3B schematically shows the front-side composite layer 20M2. Since fibers (one of which is shown at 20*c*) of the front-side clothlike material 20 intrude into and are anchored to the first and second layer portions 21, 2 2M2 , these fibers serve as abridge that binds the two layer portions 21, 22M2 together, to thereby accomplish the reinforcement. Thus, the first layer portion 21 is hardly separated from the second layer portion 22M2, and both the layer portions are fibered and reinforced. In a case where the front-side clothlike material 20 is formed of either knitted cloth or unwoven cloth, the layer portions 21, 22M2 are hardly torn or broken when the pad is struck.

The body portion 14 joined at its front and rear surfaces with the front-side and rear-side composite layers 20M2, 30M2 is taken out from the mold 24. Thereafter, the base portion 40 separately fabricated is attached to the body portion 14. Specifically, the separate paper 33 affixed to the composite layer 30M2 is removed to thereby expose the pressure sensitive adhesive 31, and the base portion 40 is affixed or adhered at its upper surface 40*a* (upper surface of the first metal plate 41) to the exposed adhesive 31, whereby the base portion 40 is fixed to the rear surface 32*b* of the rear-side clothlike material 32M2, and the drum pad 10 is completed.

Since the resin material 12 has stretchability and the front-side clothlike material 20 has two-way stretchability, high stretchability can be obtained. Accordingly, when the percussion surface 10*a* is struck, a struck portion thereof is locally deformed and produces a large resiliency. As a result, a percussion feeling is not hard and the stick 11 rebounds well.

As previously described, the base portion 40 of this embodiment has the enhanced vibration damping effect by the three-layer structure. In the following, the vibration damping effect of the three-layer structure is compared with those of other structures than the three-layer structure. Hereinafter, the three-layer structured base portion (i.e., the base portion 40) will be referred to as the constrained type, a base portion comprised of only the first metal plate 41 and the resin layer 43 provided on the rear side of the metal plate 41 (i.e., a base portion where the second metal plate 42 is removed from the base portion 40) will be referred to as the unconstrained type, and a base portion comprised of only the first metal plate 41 (i.e., a base portion where the resin layer 43 and the second metal plate 42 are removed from the base portion 40 so that the vibration damping function is eliminated) will be referred to as the non-damping type.

Figure 4A:
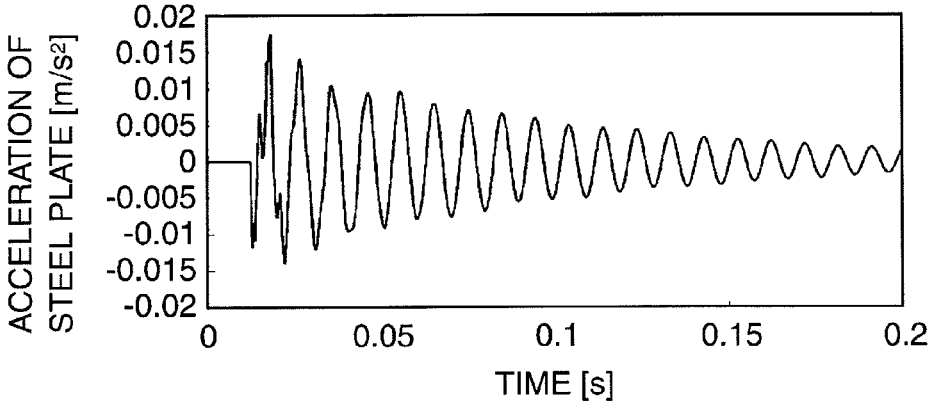
FIG. 4A to FIG. 4C are views respectively showing damping times of vibration acceleration of base portions of non-damping type, unconstrained type, and constrained type.
Figure 4B:
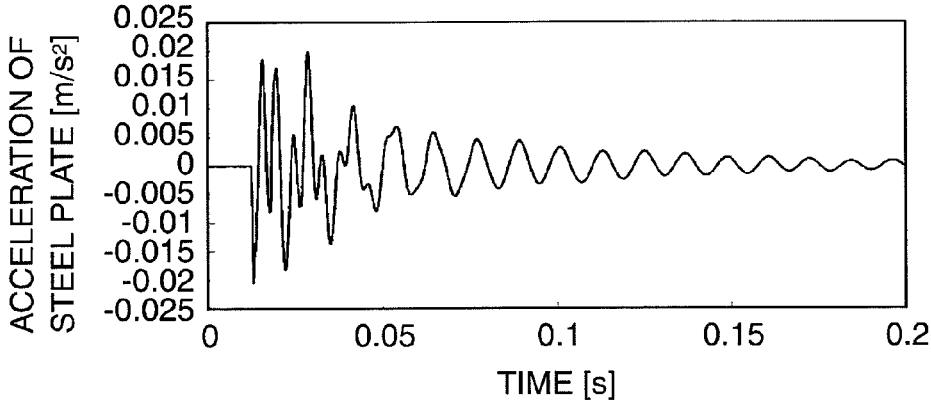
Figure 4C:
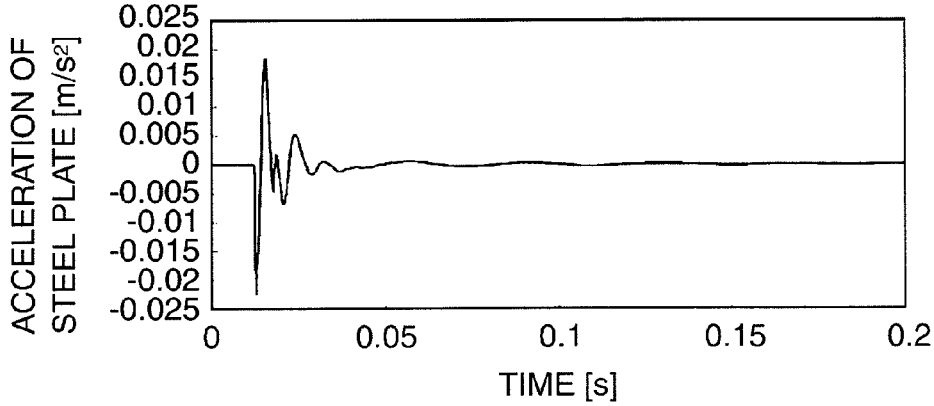
Figure 5A:
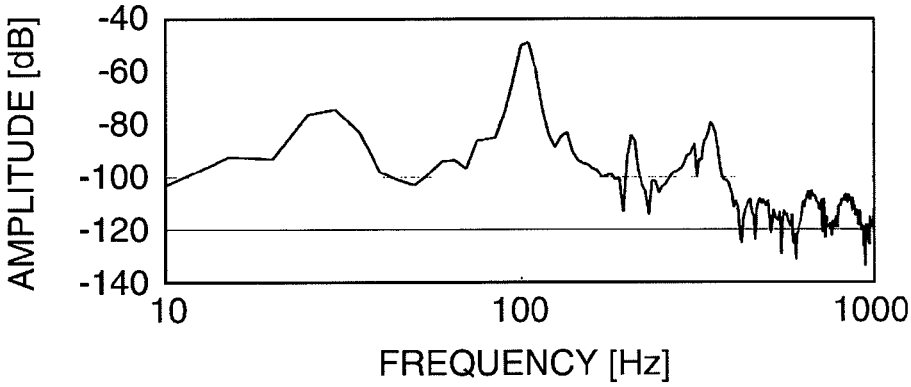
FIG. 5A to FIG. 5C are views respectively showing relations between vibration amplitude and vibration frequency of the base portions of non-damping type, unconstrained type, and constrained type.
Figure 5B:
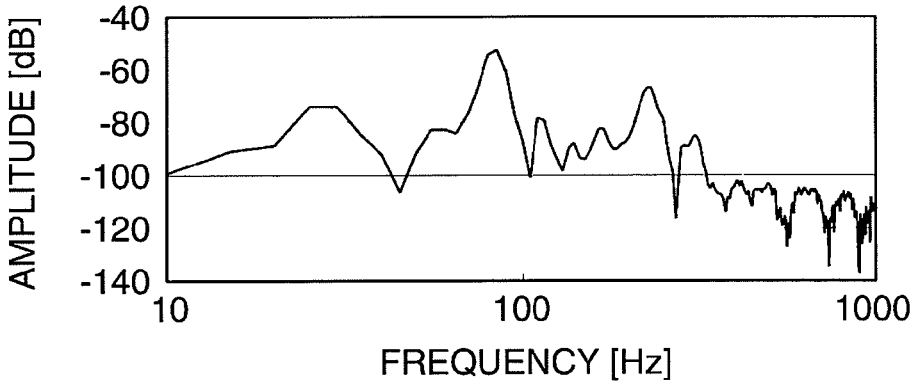
Figure 5C:
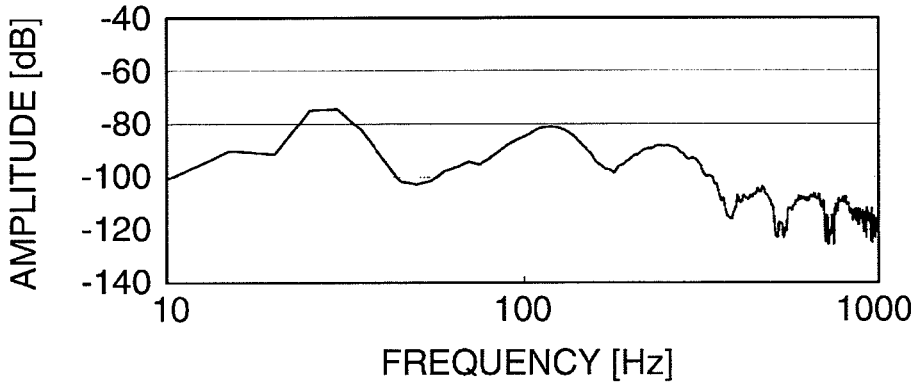

FIG. 4A to FIG. 4C respectively show damping times of vibration acceleration of the base portions of non-damping, unconstrained, and constrained types, where elapsed time (second) from when each base portion is struck is taken along the abscissa and vibration acceleration (m/sec$^2$) is taken along the ordinate. FIG. 5A to FIG. 5C respectively show relations between vibration amplitude and vibration frequency of the base portions of non-damping, unconstrained, and constrained types, where vibration amplitude (dB) is taken along the abscissa and vibration frequency (Hz) is taken along the ordinate.

In actual measurements of the vibration acceleration and vibration amplitude-frequency characteristic of each base portion, an acceleration pickup was disposed at the center of a rear surface of the base portion, and the center of a percussion surface was struck by a predetermined load. An electrolytic zinc-plated steel sheet (SECC) was used as the first and second metal plates 41 and 42, and vinyl chloride was used as the resin layer 43.

The actually measured vibration acceleration of each base portion represents the magnitude of vertical displacement of the base portion, which provides a measure of vibration intensity or vibration energy. As understood from FIGS. 4A to 4C, the vibration of the base portion of non-damping type was not damped immediately and continued even after elapse of 0.2 seconds from the striking, the vibration of the unconstrained type was damped somewhat rapidly and nearly damped at the elapsed time of 0.2 seconds, and the vibration of the constrained type was damped rapidly and damped to nearly zero at the elapsed time of 0.02 seconds . To attain the desired vibration containing less noise components and to attain a large damping effect, it is the to be preferable that the vibration of the base portion be damped to nearly zero within the elapsed time of 0.1 seconds. The constrained type sufficiently satisfies such requirement.

To attain the desired vibration damping effect, the damping effect in a high-frequency range, especially, in a frequency range of 80 Hz to 350 Hz, is important . In the case of the non-damping type, a highly sharp resonance crest appears at a frequency of near 100 Hz and resonance crests appear in a frequency range of 200 Hz to 350 Hz, as shown in FIG. 5A. In the case of the unconstrained type as shown in FIG. 5B, similar resonance crests are found, but the sharpness of the crests is slightly moderated. In the case of the constrained type as shown in FIG. 5C, no resonance crest is found in a high-frequency range although a low resonance crest is found at a frequency range of less than 80 Hz, which does not affect the sounding of a percussion sound. Thus, an excellent damping effect is recognized.

According to this embodiment, the resin material 12 is thermally fused and bonded to the front-side clothlike material 20 to thereby obtain the temporary composite layer 20M1, and the rubber material 13 is foamed and solidified between the separate paper-equipped composite layer 35 and the temporary composite layer 20M1, thereby molding the body portion 14.

In the drum pad 10 which is in a preparatory stage and to which the base portion 40 is subsequently adhered, the rubber material 13 has been impregnated into the rear-side clothlike material 32M2 made of knitted material, the body portion 14 has been joined to the front surface 32*a* of the rear-side clothlike material 32M2, and the pressure sensitive adhesive 31 has been applied to the rear surface 32*b* of the rear-side clothlike material 32M2.

Accordingly, it is possible to stick the pressure sensitive adhesive 31 to the body portion 14 via the rear-side clothlike material 32M2, even if the adhesive 31 is non-special adhesive that cannot directly be stuck to the body portion 14 made of rubber material 13. Thus, by using the pressure sensitive adhesive 31, the base portion 40 having a metallic adhered surface can securely be adhered to the rear surface of the pad portion 15 made of rubber (i.e., to the lower surface 14*b* of the body portion 14). In addition, the body portion 14 formed by the rubber material 13 of silicone rubber has a large rebound coefficient and provides a satisfactory percussion feeling.

Since the front-side composite layer 20M2 is formed by the first layer portion 21 intruded with the resin material 12 and by the second layer portion 22M2 impregnated with the rubber material 13 and since the front-side composite layer 20M2 is basically formed of knitted material or the like, the stick 11 is rebounded in a direction similar to that in an acoustic drum, and therefore, a natural percussion feeling can be realized. In addition, since the percussion surface 10*a* is provided by the first layer portion 21 in which the resin material 12 is intruded and solidified, it is possible to improve the quietness and enhance the impact strength. Besides, since the knitted material is protected by the resin material 12, a large effect of preventing contamination can be attained. It is therefore possible to prevent the percussion surface 10*a* from being contaminated, to maintain the durability of the percussion surface 10*a*, and to achieve a natural excellent percussion feeling.

Since the rubber material 13 can be impregnated into the temporary rear-side clothlike material 32M1 and into the temporary second layer portion 22M1 in one molding process, processing on the front side and processing on the rear side can be performed concurrently, whereby the fabrication process can be simplified. It should be noted that the rubber material 13 can be foamed in two stages so as to separately perform a process for impregnating the rubber material 13 into the clothlike material 32M1 and a process for impregnating the rubber material 13 into the layer portion 22M1.

When the rubber material 13 formed of silicone rubber having a siloxan bond is used, liquid rubber can be used as the rubber material 13 that can easily be cast into the mold and that is effective to fabricate a drum pad which is excellent in resiliency and weather resistance. The rubber material 13 formed of foamed rubber is effective to fabricate a softly bouncy percussion surface.

According to this embodiment, since the base portion 40 provided on the rear side of the pad portion 15 (i.e., on the lower surface 14*b* of the body portion 14) and mounted with the percussion sensor 19 has the three-layer structure in which the resin layer 43 is disposed between the first and second metal plates 41 and 42, it is possible to suppress a mechanical percussion sound and enhance the effect of damping a high-frequency vibration produced by the striking, making it possible to prevent an error when producing a sound based on percussion detection. The resultant vibration contains less noise components and is uniform in amplitude over a wide frequency range.

Since the thickness t1 of the metal plates 41, 42 is set in a range of 0.3 mm to 2.3 mm and the thickness t2 of the resin layer 43 is set in a range of 0.1 mm to 0.5 mm, it is possible to attain a proper damping effect in a high-frequency region, while suppressing the cost.

Since the metal plates 41, 42 have the same construction, it is possible to reduce the number of component parts and to simplify the construction.

In this embodiment, on the rear surface 32*b* of the rear-side clothlike material 32M2 (i.e., on the lower surface of the temporary rear-side clothlike material 32M1), there is provided a fixing layer formed of the pressure sensitive adhesive 31, but the fixing layer is not limited thereto. For example, the fixing layer can be formed by an adhesive. In that case, e.g., an adhesive film of hot melt type can be intruded, fused, and bonded to a lower half region of the clothlike material 32M1, and can be fused and bonded to the body portion 14 before or after the base portion 40 is molded. Alternatively, it is possible to apply a liquid adhesive agent to the base portion 40, to place the clothlike material 32M1 on a surface of the base portion 40 to which the liquid adhesive agent has been applied to thereby cause the liquid adhesive agent to intrude into a lower half region of the clothlike material 32M1, and to solidify the liquid adhesive agent so as to be integral with the clothlike material 32M1. Thereafter, the body portion 14 is molded so that the rubber material 13 is intruded into clothlike material 32M1 and made integral therewith.

In this embodiment, the body portion 14 is formed of the rubber material 13 in order to improve a percussion feeling and weather resistance. Although it is generally difficult to adhere an urethane film or metal to silicone-based rubber, this embodiment makes it possible to join silicone-based rubber to the body portion 14 via the front-side and rear-side clothlike materials 20, 32M2 formed of a knitted material or the like, whereby silicone-based rubber can easily be used.

A fixing technique using impregnation of the rubber material 13 makes it possible to easily combine a laminated damping steel sheet of a multi-layered structure (such as the base portion 40) and a pad portion formed of silicone based-rubber although silicone-based rubber cannot heretofore be used for the base portion 40 since the silicone-based rubber is hard to stick to the base portion 40, which has the metal plates 41, 42 and is heavy in weight .

It is considered that the impregnation speed of the rubber material 13 into the front-side clothlike material 20 varies from location to location. On this point, the first layer portion 21 of this embodiment has a function of stopping the impregnation of the rubber material 13 at the boundary portion 23, whereby a fear of causing a variation in impregnation region can be eliminated, making it possible to attain the percussion surface 10*a* which is smooth and uniform in characteristic.

The method of molding the drum pad 10 using a mold is not limited to the above-described method.

Figure 6A:
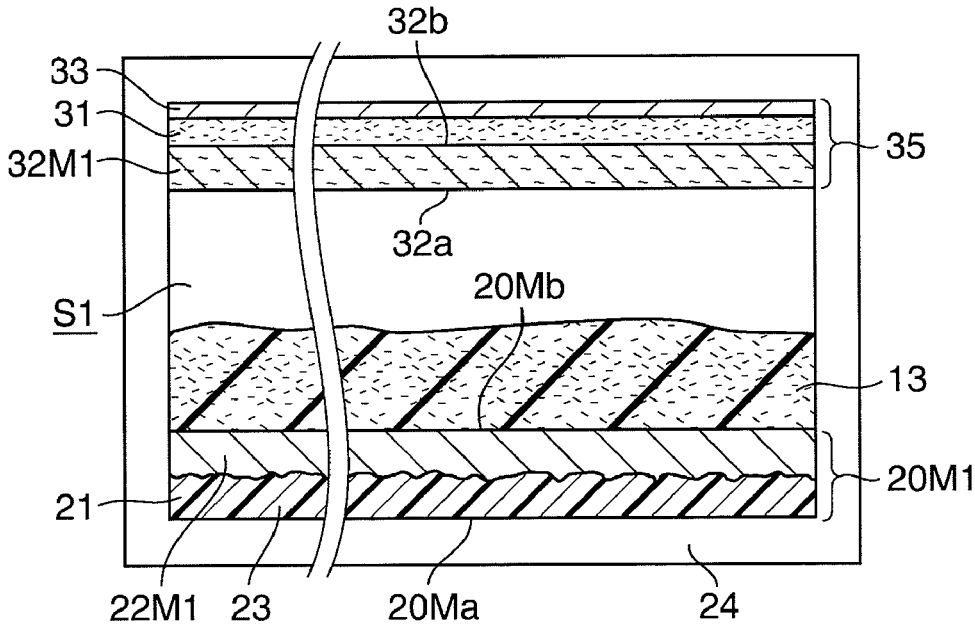
FIGS. 6A and 6B are views showing modifications of the molding process of the drum pad.

For example, as in a modification shown in FIG. 6A, a positional relation between the separate paper-equipped composite layer 35 and the temporary composite layer 20M1 in the mold 24 can be turned upside down as compared with that in the above-described example.

Figure 6B:
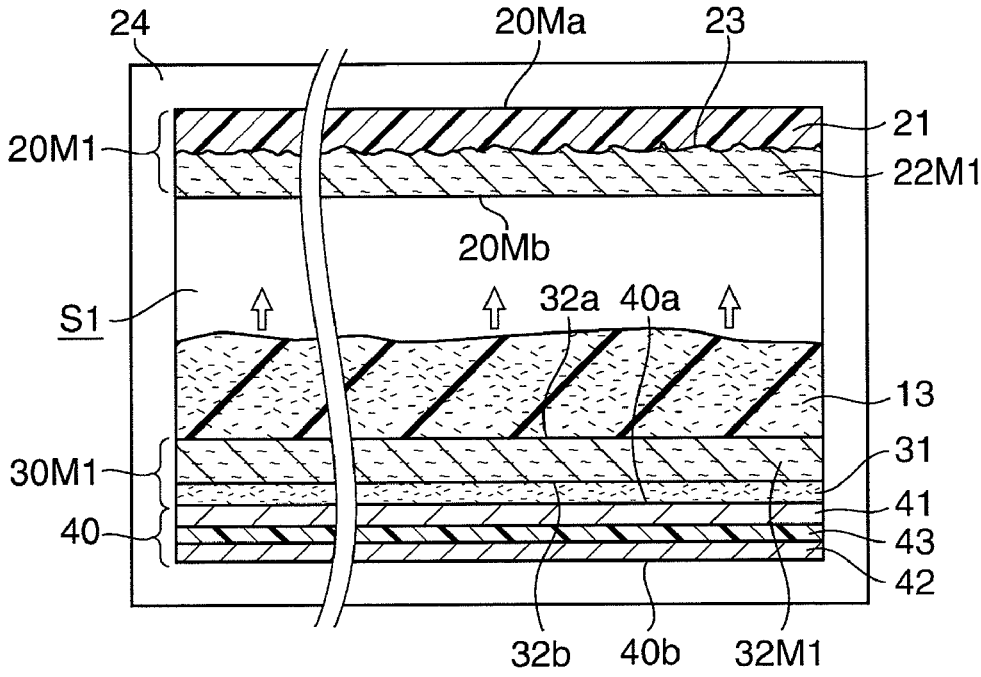

Although the separate paper-equipped composite layer 35 is set at the bottom of the mold 24 in the molding process shown in FIG. 3A, the temporary composite layer 30M1 adhered in advance with the base portion 40 can be set in the mold 24 as shown in FIG. 6B. In that case, the composite layer 35 from which the separate paper 33 has been peeled off and to which the base portion 40 has been adhered is set at the bottom of the mold 24. Then, the drum pad 10 is molded as previously described.

It should be noted that there are various modifications of a raw material of the rubber material 13. Although foamed rubber is used as the rubber material 13 in the embodiment, non-foamed rubber can be used. For example, non-foamed silicone rubber formed by not foaming but solidifying liquid silicone or non-foamed urethane resin formed by not foaming but solidifying liquid urethane resin can be used.

In this modification, e.g., the molding process shown in FIG. 6A is performed by using the mold 24 having a lid mold and a lower mold (none of which are shown). Specifically, the rubber material 13 (non-foamed resin) is cast between the separate paper-equipped composite layer 35 and the temporary composite layer 20M1, and all of these (i.e., the composite layer 20M1, rubber material 13, and the composite layer 35) is pressurized, heated, and then solidified. As a result, the body portion 14 is molded and the entire shape is defined by the mold 24. An excessive of the rubber material 13 is overflown from a gap between the lower mold and the lid mold.

Instead of using liquid resin as the rubber material 13, a non-vulcanized rubber compound may be used. In this modification, there can be used as raw materials of the rubber material 13, e.g., rubber materials mainly including NR (natural rubber) and BR (butadiene rubber) whose mixture ratio is that: 40 parts of NR, 60 parts of BR, and the remaining parts of additive materials including 3 parts of zinc oxide, 1 part of stearic acid, 6 parts of sulfur, 15 parts of calcium carbonate, and 10 parts of carbon. These are kneaded by the use of a roll to produce the rubber material 13 formed of the compound.

Next, e.g., the molding process shown in FIG. 6A is performed by using the mold 24 . Specifically, the rubber material 13 (non-vulcanized rubber compound) is placed on the temporary composite layer 20M1, and the separate paper-equipped composite layer 35 is laid over the rubber material 13. Then, all of these (i.e., the temporary composite layer 20M1, rubber material 13, and composite layer 35) is pressurized and heated at 160 degree C. for 10 minutes. The rubber material 13 is first softened and impregnated into the temporary rear-side clothlike material 32M1 and into the temporary second layer portion 22M1. As a result, the clothlike material 32M1 and the layer portion 22M1 become the rear-side clothlike material 32M2 and the second layer portion 22M2 (which are shown in FIG. 1B), respectively. A part of the rubber material 13 is overflown from a gap between the lower mold and the lid mold of the mold 24. The vulcanization is performed to obtain the body portion 14 formed of elastic rubber.

To produce the rubber material 13 formed of the compound in the just-mentioned modification, 4 parts of a foaming agent (for example, 4,4'-oxybis benzene sulfonyl hydralazide whose decomposition temperature is 160 degrees C.) can be further added, as an additive material.

In that case, as described in the modification, the temporary composite layer 20M1, the rubber material 13, and the separate paper-equipped composite layer 35 are disposed in the mold 24, and then pressurized and heated. The rubber material 13 is first softened and impregnated into the temporary rear-side clothlike material 32M1 and the temporary second layer portion 22M1, whereupon the clothlike material 32M1 and the layer portion 22M1 become the rear-side clothlike material 32M2 and the second layer portion 22M2 (which are shown in FIG. 1B), respectively. Thereafter, the softened rubber material starts foaming and vulcanization starts at the same time, and therefore, the pressure of the mold is gradually decreased. Then, the softened rubber material expands due to the foaming pressure and fills the space S1 in the mold 24, thereby obtaining the body portion 14.

Also in these modifications, the vertical positional relation between the separate paper-equipped composite layer 35 and the temporary composite layer 20M1 in the mold 24 is not limited, and the base portion 40 can be adhered in advance to the temporary composite layer 30M1 before the start of the molding process.

As described in the embodiment, the raw material of the body portion 14 is not limited to foamy silicone rubber, but may be non-silicone rubber or non-foamy rubber. Examples of the usable foamy rubber include urethane rubber, natural rubber, and butadiene rubber. Examples of the usable non-foamy rubber include silicone rubber, urethane rubber, natural rubber, and butadiene rubber.

The base portion 40 is not limited to one having the three-layer structure, but may have a structure of four or more layers, where a metal plate is disposed on the uppermost side and metal plates and resin layers are alternately stacked. For example, the base portion 40 has a five-layer structure where the first metal plate 41, resin layer 43, second metal plate 42, resin layer 43, and first metal plate 41 are stacked in this order from above. It should be noted that in the base portion 40, acryl plates or the like can be used instead of the metal plates.

It is not inevitably necessary to dispose the percussion sensor 19 on the lower surface 40*b* of the base portion 40. The percussion sensor 19 can be disposed, e.g., at a location on the base portion 40 other than the lower surface 40*b*, or inside the body portion 14, or between the body portion 14 and the base portion 40.

As previously described, the two-liquid type RTV rubber is used as the rubber material 13. In the process where the mixture of liquid materials A and B for the two-liquid type RTV rubber is formed and solidified in the mold 24 and impregnated into the temporary rear-side clothlike material 32M1 and the temporary second layer portion 22M1, gases (e.g., hydrogen gases) are generated by a chemical reaction between the liquid materials A and B. It is assumed here that the temporary composite layer 30M1 and the base portion 40 adhered in advance to the composite layer 30M1 are set at the bottom of the mold 24 as shown in FIG. 6B and the base portion 40 is insert-molded. In that case, the generated gases are able to escape laterally via the temporary second layer portion 22M1 and the temporary rear-side clothlike material 32M1.

However, since the first metal plate 41 of the base portion 40 does not permit gases to pass therethough, the generated gases present in a region near the center of the first metal plate 41 cannot escape laterally and accumulate therein, resulting in a problem that the first metal plate 41 at the center region is liable to be peeled off from the temporary composite layer 30M1.

To obviate this, it is preferable that vent holes that allow gases generated in the molding process to escape therethrough be formed in the first metal plate 41 of the base portion 40, as will be described with reference to FIGS. 7A and 7B.

Figure 7A:
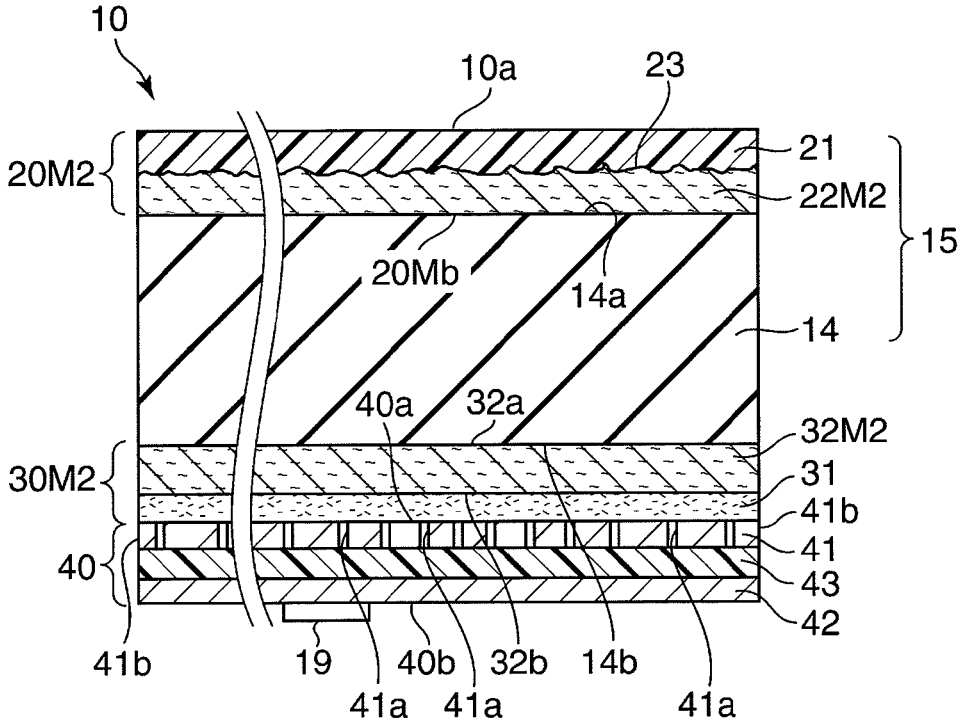
FIG. 7A is a section view schematically showing the construction of a drum pad having abase portion formed with vent holes.
Figure 7B:
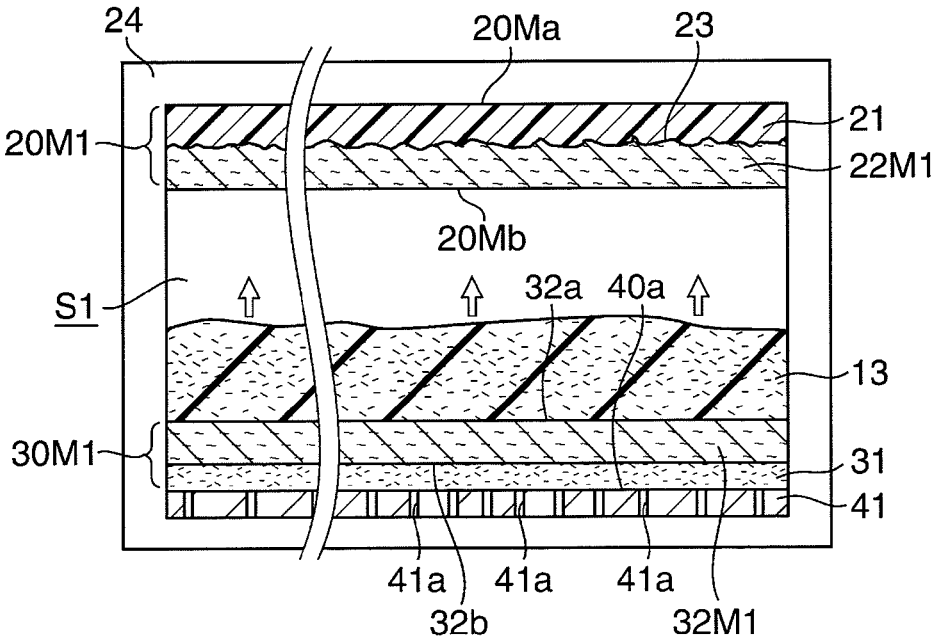
FIG. 7B is a view showing a molding process of the drum pad shown in FIG. 7A.

FIG. 7A schematically show in cross section the construction of the drum pad 10 having the base portion 40 formed with vent holes, and FIG. 7B shows a process for molding the drum pad 10 shown in FIG. 7A.

As shown in FIG. 7A, a number of vent holes 41*a* are formed in the first metal plate 41 of the base portion 40 so as to extend therethrough in a front-rear direction (vertical direction). The vent holes 41*a* each have a diameter of, e.g., 1.6 mm. The vent holes 41*a* are arranged to have a higher density in a region much away from an outer periphery 41*b* of the first metal plate 41. In other words, a larger number of vent holes 41*a* are formed in a region closer to the center of the first metal plate 41. As a result, the generated gases are able to easily escape from the center region of the first metal plate 41 via the vent holes 41*a*.

The vent holes 41*a* can have any size that enables the generated gases to escape therethrough. The size of the vent holes 41*a* can be determined by taking into account of the ease of hole formation. For example, in the case of being formed by press working, it is preferable that the vent holes 41*a* have a diameter of 1.6 mm, but can have a diameter of less than 1.6 mm. If the vent holes 41*a* has a sufficient total area, the density in which the vent holes 41*a* are formed becomes somewhat insignificant, and hence the vent holes 41*a* can be formed at equal intervals of, e.g., 40 mm. The vent holes 41*a* can be formed by any method. For example, the vent holes can be formed using a drill.

In the molding, the first metal plate 41 formed with the vent holes 41*a* is first adhered at its upper surface to the lower surface of the temporary rear-side clothlike material 32M1 by the pressure sensitive adhesive 31. Next, the first metal plate 41 and the clothlike material 32M1 affixed together are placed on the bottom of the mold 24, with the clothlike material 32M1 disposed upward of the plate 41, and the temporary composite layer 20M1 is placed on the ceiling side, with the temporary second layer portion 22M1 disposed downward of the first layer portion 21. Then, the rubber material 13 is cast between the temporary composite layers 20M1 and 30M1, thereby molding the body portion 14.

Among hydrogen gases generated in the molding process, a gas flowing to or generated at near the first metal plate 41 escapes to the outside of a product being molded via the temporary rear-side clothlike material 32M1 and the pressure sensitive adhesive 31 and via the vent holes 41*a*. Since minute clearances through which gases are able to pass are present in the clothlike material 32M1 and the pressure sensitive adhesive 31, it is unnecessary to additionally provide a venting structure. If residual gases are present after the rear-side clothlike material 32M2 (see FIG. 1B) is formed by causing the rubber material 13 to impregnate into the clothlike material 32M1, the residual gases can be purged via the vent holes 41*a*.

Subsequently, the base portion 40 is formed by adhering the second metal plate 42 to the first metal plate 41 via the resin layer 43, whereby the molded product shown in FIG. 7A is completed.

As described above, with the construction shown in FIG. 7A, the first metal plate 41 and the rear-side clothlike material 32M2 are prevented from being peeled off from each other by gases generated in the molding process, thereby making it possible to maintain high adhesion strength between the body portion 14 and the base portion 40.

In the molding process, the base portion 40 having the first and second metal plates 41, 42 affixed together via the resin layer 43 can be placed on the bottom of the mold 24. In that case, the resin layer 43 must be formed by a material that has heat resistance and permits gases to pass therethrough. Vent holes similar to those formed in the first metal plate 41 can also be formed in the second metal plate 42.

It is possible to form vent holes in the first metal plate 41 of the unconstrained type having the two-layer structure of the first metal plate 41 and the resin layer 43, or in the first metal plate 41 of the non-damping type having only the first metal plate 41, or in the first metal plate 41 and/or the second metal plate 42 of the five-layer structure having the first metal plate 41, resin layer 43, second metal plate 42, resin layer 43, and first metal plate 41, which are stacked in this order.

It should be noted that gases to be purged via the vent holes 41*a* are not limited to hydrogen gases. Since being are widely applicable to the venting of gases generated in the molding process irrespective of the type of rubber and of molding process, the vent holes 41*a* are useful for any process in which gases are generated.

What is claimed is:

1. A drum pad, comprising:

a body portion made of rubber and having a rear surface thereof on a side opposite from a side where the drum pad is struck;

a rear-side clothlike material provided on the rear surface of said body portion; and a fixing layer made of adhesive and provided on a rear surface of said rear-side clothlike material, wherein said body portion is joined to a front surface of said rear-side clothlike material by impregnating said rear-side clothlike material with the rubber of the body portion.

2. The drum pad according to claim 1, wherein the rear-side clothlike material is one of a knitted material and unwoven cloth.

3. The drum pad according to claim 1, further comprising:

a base portion fixed to the rear surface of said rear-side clothlike material via said fixing layer.

4. The drum pad according to claim 1, further comprising:

a front-side clothlike material having a rear surface thereof to which said body portion is joined and a front surface thereof opposite from the rear surface of said front-side clothlike material, wherein said front-side clothlike material comprises a first layer portion on a side of the front surface of said front-side clothlike material, the first layer portion formed by intruding a stretchable resin material into said front-side clothlike material, and a second layer portion between the first layer portion and said body portion, the second layer portion being impregnated with the rubber of the body portion.

5. The drum pad according to claim 4, wherein the front-side clothlike material is one of a knitted material and unwoven cloth.

6. The drum pad according to claim 1, wherein the rubber comprises foamed rubber.

7. The drum pad according to claim 1, wherein the rubber comprises silicone rubber having a siloxane bond.

8. A drum pad comprising:

a pad portion having a surface thereof adapted to be struck; and a base portion disposed on a rear side of said pad portion, wherein said base portion comprises first and second metal plates and a resin layer interposed between the first and second metal plates.

9. The drum pad according to claim 8, further comprising:

a percussion sensor configured to detect a vibration of said base portion to thereby detect striking of the surface of said pad portion.

10. The drum pad according to claim 9, wherein the first and second metal plates each have a thickness in a range of 0.3 mm to 2.3 mm, and the resin layer has a thickness equal to or larger than 0.1 mm.

11. The drum pad according to claim 9, wherein the resin layer is thinner than the first metal plate or the second metal plate, whichever is thinner.

12. The drum pad according to claim 9, wherein the first and second metal plates have a same construction.

13. A drum pad comprising:

a body portion made of rubber and having a rear surface thereof on a side opposite from a side where the drum pad is struck;

a rear-side clothlike material provided on the rear surface of said body portion; and a base portion having at least a member formed with holes extending therethrough in a front-rear direction, said base portion being fixed at a side of the member to a rear surface of said rear-side clothlike material via a fixing layer made of adhesive, wherein said body portion is joined to a front surface of said rear-side clothlike material by impregnating said rear-side clothlike material with the rubber of the body portion.

14. The drum pad according to claim 13, wherein the rear-side clothlike material is one of a knitted material and unwoven cloth.

15. The drum pad according to claim 13, wherein the holes are distributed in a higher density in a region further away from an outer periphery of said base portion.

16. The drum pad according to claim 13, further comprising:

a front-side clothlike material having a rear surface thereof to which said body portion is joined and a front surface thereof opposite from the rear surface of said front-side clothlike material, wherein said front-side clothlike material comprises a first layer portion on a side of the front surface of said front-side clothlike material, the first layer portion formed by intruding a stretchable resin into said front-side clothlike material, and a second layer portion between the first layer portion and said body portion, the second layer portion being impregnated with the rubber of the body portion.

17. The drum pad according to claim 16, wherein the front-side clothlike material is one of a knitted material and unwoven cloth.

18. The drum pad according to claim 13, wherein the rubber comprises foamed rubber.

19. The drum pad according to claim 13, wherein the rubber comprises silicone rubber having a siloxane bond.

20. A manufacturing method of a drum pad comprising a body portion having a rear surface thereof on a side opposite from a side where the drum pad is struck, and a rear-side clothlike material provided on the rear surface of the body portion, the method comprising:

a disposing step of disposing the rear-side clothlike material in the mold, a rear surface of the rear-side clothlike material provided with a fixed layer made of adhesive and a molding step of casting liquid resin material or thermally-softened non-vulcanized rubber into a mold, to thereby form the body portion made of rubber and join the body portion to the front surface of the rear-side clothlike material by impregnating the rear-side clothlike material with the liquid resin material or thermally-softened non-vulcanized rubber.

21. The manufacturing method according to claim 20, wherein the rear-side clothlike material is one of a knitted material and unwoven cloth.

22. The manufacturing method according to claim 20, wherein the rubber comprises foamed rubber.

23. The manufacturing method according to claim 20, wherein the rubber comprises silicone rubber having a siloxane bond.

24. A manufacturing method of a drum pad comprising a front-side clothlike material that has a front surface thereof on a side where the drum pad is struck and a rear surface thereof opposite from the front surface, a body portion having a front surface thereof affixed to the rear surface of the front-side clothlike material and a rear surface thereof opposite from the front surface thereof, and a rear-side clothlike material provided on the rear surface of the body portion, the method comprising:

a thermal adhesion step of forming a first layer portion in the front-side clothlike material on a side of the front surface thereof by intruding the front surface of the front-side clothlike material with a molten stretchable resin material which is solidified integrally with the front-side clothlike material;

a disposing step of disposing the front-side clothlike material with the first layer portion in a mold;

a disposing step of disposing the rear-side clothlike material in the mold, a front surface of the rear-side clothlike material opposite to the rear surface of the front-side clothlike material, a rear surface of the rear-side clothlike material provided with a fixing layer of adhesive; and a molding step of casting liquid resin material or thermally-softened non-vulcanized rubber into a mold from between the rear surface of the front-side clothlike material and a front surface of the rear-side clothlike material to thereby form the body portion made of rubber, wherein a second layer portion in the front-side clothlike material is formed by impregnating the front-side clothlike material with the liquid resin material or thermally-softened non-vulcanized rubber between the first layer portion of the front-side clothlike material and the body portion, thereby joining the body portion to the rear surface of the front-side clothlike material, and wherein the rear-side clothlike material is impregnated with the liquid resin material or thermally-softened non-vulcanized rubber, thereby joining the body portion to the front surface of the rear-side clothlike material.

25. The manufacturing method according to claim 24, wherein the rear-side clothlike material is one of a knitted material and unwoven cloth.

26. The manufacturing method according to claim 24, wherein the front-side clothlike material is one of a knitted material and unwoven cloth.

27. The manufacturing method according to claim 24, wherein the rubber comprises foamed rubber.

28. The manufacturing method according to claim 24, wherein the rubber comprises silicone rubber having a siloxane bond.

29. A manufacturing method of a drum pad comprising a body portion having a rear surface thereof on a side opposite from a side where the drum pad is struck, and a rear-side clothlike material provided on the rear surface of the body portion, the method comprising:

a disposing step of disposing in a mold a rear-side clothlike material with a rear surface affixed to a base portion via a fixing layer made of adhesive, the base portion comprising at least a member formed with holes extending therethrough in a front-rear direction; and a molding step of casting liquid resin material or thermally-softened non-vulcanized rubber into a mold from the side close to the front surface of the rear-side clothlike material, to thereby form the body portion made of rubber and join the body portion to the front surface of the rear-side clothlike material by impregnating the rear-side clothlike material with the liquid resin material or thermally-softened non-vulcanized rubber.

30. The manufacturing method according to claim 29, wherein the rear-side clothlike material is one of a knitted material and unwoven cloth.

31. The manufacturing method according to claim 29, wherein the rubber comprises foamed rubber.

32. The manufacturing method according to claim 29, wherein the rubber comprises silicone rubber having a siloxane bond.

33. A manufacturing method of a drum pad comprising a front-side clothlike material that has a front surface thereof on a side where the drum pad is struck and a rear surface thereof opposite from the front surface, a body portion having a front surface thereof affixed to the rear surface of the front-side clothlike material and a rear surface thereof opposite from the front surface thereof, and a rear-side clothlike material provided on the rear surface of the body portion, the method comprising:

a thermal adhesion step of forming a first layer portion in the front-side clothlike material on a side of the front surface thereof by intruding the front surface of the front-side clothlike material with a molten stretchable resin material which is solidified integrally with the front-side clothlike material;

a disposing step of disposing the front-side clothlike material with the first layer portion in a mold;

a disposing step of disposing in a mold the rear-side clothlike material in a mold, a front surface of the rear-side clothlike material opposite to the rear surface of the front-side clothlike material, the rear-side cloth material with a rear surface affixed to a base portion via a fixing layer made of adhesive, the base portion comprising at least a member formed with holes extending therethrough in a front-rear direction; and a molding step of casting liquid resin material or thermally-softened non-vulcanized rubber into a mold from between the rear surface of the front-side clothlike material and a front surface of the rear-side clothlike material, to thereby form the body portion made of rubber, wherein a second layer portion in the front-side clothlike material is formed by impregnating the front-side clothlike material with the liquid resin material or thermally-softened non-vulcanized rubber between the first layer portion of the front-side clothlike material and the body portion, thereby joining the body portion to the rear surface of the front-side clothlike material, and wherein the rear-side clothlike material is impregnated with the liquid resin material or thermally-softened non-vulcanized rubber, thereby joining the body portion to the front surface of the rear-side clothlike material.

34. The manufacturing method according to claim 33, wherein the rear-side clothlike material is one of a knitted material and unwoven cloth.

35. The manufacturing method according to claim 33, wherein the front-side clothlike material is one of a knitted material and unwoven cloth.

36. The manufacturing method according to claim 33, wherein the rubber comprises foamed rubber.

37. The manufacturing method according to claim 33, wherein the rubber comprises silicone rubber having a siloxane bond.

* * * * *